US009719282B2

(12) United States Patent
Bellei

(10) Patent No.: US 9,719,282 B2
(45) Date of Patent: Aug. 1, 2017

(54) GUIDE SYSTEM FOR A SLIDING DOOR

(71) Applicant: ROTA INFISSI S.R.L., Carpi (Modena) (IT)

(72) Inventor: Antonio Bellei, Carpi (IT)

(73) Assignee: ROTA INFISSI S.R.L., Carpi (IT)

( * ) Notice: Subject to any disclaimer, the term of this patent is extended or adjusted under 35 U.S.C. 154(b) by 0 days.

(21) Appl. No.: 14/652,614

(22) PCT Filed: May 27, 2013

(86) PCT No.: PCT/IB2013/054378

§ 371 (c)(1),
(2) Date: Jun. 16, 2015

(87) PCT Pub. No.: WO2014/128536

PCT Pub. Date: Aug. 28, 2014

(65) Prior Publication Data

US 2015/0345198 A1 Dec. 3, 2015

(30) Foreign Application Priority Data

Feb. 25, 2013 (IT) ..... MO2013A0050

(51) Int. Cl.
*E05D 15/06* (2006.01)
*E06B 3/46* (2006.01)
(Continued)

(52) U.S. Cl.
CPC ..... *E05D 15/0678* (2013.01); *E05D 13/10* (2013.01); *E05D 15/0686* (2013.01); *E05D 15/0691* (2013.01); *E05D 15/565* (2013.01); *E06B 3/4636* (2013.01); *E05D 15/0621* (2013.01); *E05D 2015/0695* (2013.01); *E05Y 2201/428* (2013.01)

(58) Field of Classification Search
USPC ..... 49/414
See application file for complete search history.

(56) References Cited

U.S. PATENT DOCUMENTS 3,334,442 A * 8/1967 Boettcher ..... E05D 15/0621 16/87 R
3,346,993 A * 10/1967 Johnson ..... E05D 15/066 16/320

(Continued)

FOREIGN PATENT DOCUMENTS

DE 102008023511 A1 11/2009
DE WO 2009138154 A1 * 11/2009 ..... E05D 15/165

(Continued)

OTHER PUBLICATIONS

Machine translation of WO 2009138154.*

*Primary Examiner* — Katherine Mitchell
*Assistant Examiner* — Marcus Menezes
(74) *Attorney, Agent, or Firm* — Pearne & Gordon LLP

(57) ABSTRACT

A guide system (1) for a sliding door (101) comprises a pair of guides (3, 4) opposite each other to receive the respective opposite edges (103, 104) of a door (101); lifting means (5) for switching the door (101) from a resting position to a sliding position; the lifting means (5) is configured to produce a magnetic field inside one of the guides (3, 4) so as to bring the door (101) from the resting position to the sliding position.

11 Claims, 9 Drawing Sheets

(51) Int. Cl.
*E05D 13/00* (2006.01)
*E05D 15/56* (2006.01)

(56) References Cited

U.S. PATENT DOCUMENTS

| | | | | | |
|---|---|---|---|---|---|
| 4,575,966 | A * | 3/1986 | Gerritsen | E05D 15/0682 | 49/209 |
| 8,132,653 | B2 * | 3/2012 | Flynn | B66B 13/08 | 187/313 |
| 8,707,626 | B2 * | 4/2014 | Martin | E05D 15/0626 | 49/404 |
| 2011/0126471 | A1 * | 6/2011 | Hans | E05D 15/06 | 49/409 |
| 2012/0255229 | A1 * | 10/2012 | Rosenbeck-Mortensen | E05D 15/0621 | 49/194 |
| 2014/0041304 | A1 * | 2/2014 | Martin | E05D 15/0626 | 49/352 |

FOREIGN PATENT DOCUMENTS

| | | | | | |
|---|---|---|---|---|---|
| EP | 0741224 | A1 | 11/1996 | | |
| JP | 3960638 | B2 * | 8/2007 | E05D 15/0656 | |
| JP | WO 2011016114 | A1 * | 2/2011 | E05D 15/0621 | |
| NL | WO 2011090369 | A1 * | 7/2011 | E05D 15/0626 | |
| WO | WO 2009023083 | A1 * | 2/2009 | E05D 15/0682 | |
| WO | 2011016114 | A1 | 2/2011 | | |
| WO | 2011090369 | A1 | 7/2011 | | |

* cited by examiner

Fig.1
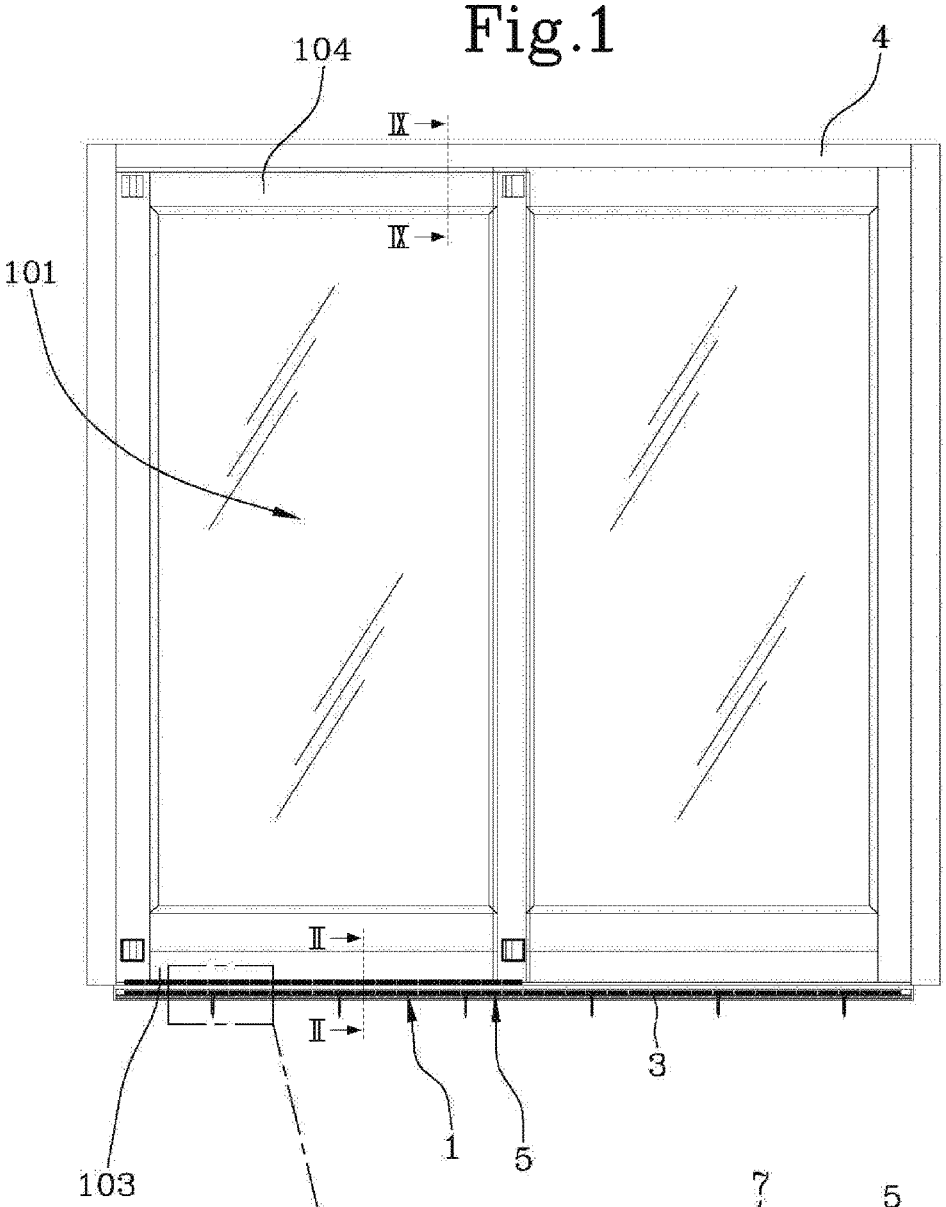
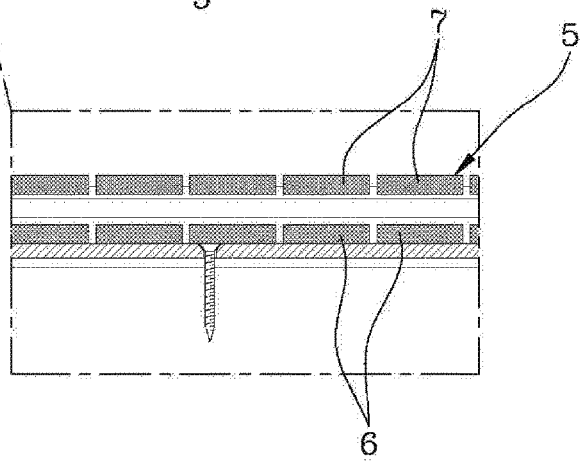
Fig.1a

GUIDE SYSTEM FOR A SLIDING DOOR

FIELD OF THE INVENTION

The object of the present invention is a guide system for a sliding door, that is to say, a set of mechanical elements predisposed to associate a sliding door with a support. In particular, the guide system according to the present invention is applicable in the building sector in casings for windows, French windows, doors, skylights and still more.

DESCRIPTION OF RELATED ART

A known type of guide system for a sliding door comprises a lower guide and an upper guide, opposite each other, and between which a sliding door is inserted. The system comprises a lifting means applied to the door.

This lifting means is predisposed to making the door pass from a resting position, in which it is locked within the guides, to a sliding position in which it is slidable and it can thus be opened by a user. In greater detail, the door rests against the lower guide in the resting position, whereas it is raised in the sliding position.

Typically, the lifting means comprises a system of mechanical levers, which, when activated by a handle, push the carriages fixed to the door downwards. These carriages come into contact with an internal base of the lower guide, and under the effect of force exerted by the user through the levers, they push the door upwards into the sliding position. In this position, the carriages enable the door to move inside the guide.

Recent developments, including for example requirements for greater thermal isolation for the windows of buildings, have led to a considerable increase in the weight of the casings. Disadvantageously, a heavier door has made the limits of the known guide system evident, that is to say that the user needs to exert considerable force, especially upon release of the door (that is, when the door is being lifted), but also during the dragging of the door inside the guide.

In this context, the technical task underlying the present invention is to offer a guide system for a sliding door that overcomes the drawbacks of the prior art cited above.

BRIEF SUMMARY OF THE INVENTION

In particular, the aim of the present invention is to make available a guide system for a sliding door that is capable of facilitating the opening and the sliding of the door.

The technical problem cited is resolved by a magnetic lifting or guide system for sliding doors, comprising the technical characteristics of attached claim 1. In particular, the lifting means is configured in such a manner as to produce a magnetic field inside one of the guides. This magnetic field exerts force on the door having an opposite direction with respect to the gravitational force.

BRIEF DESCRIPTION OF THE DRAWINGS

Further characteristics and advantages of the present invention will emerge more clearly from the indicative, and thus non-limiting, description of a preferred, but not exclusive, embodiment of a guide system for a sliding door, as illustrated in the accompanying drawings, in which:

FIG. 1 is a front view of a guide system for sliding doors according to the present invention;

FIG. 1*a* is an enlarged view of a detail of the guide system in FIG. 1;

DETAILED DESCRIPTION OF THE PREFERRED EMBODIMENTS OF THE INVENTION

Figure 2:
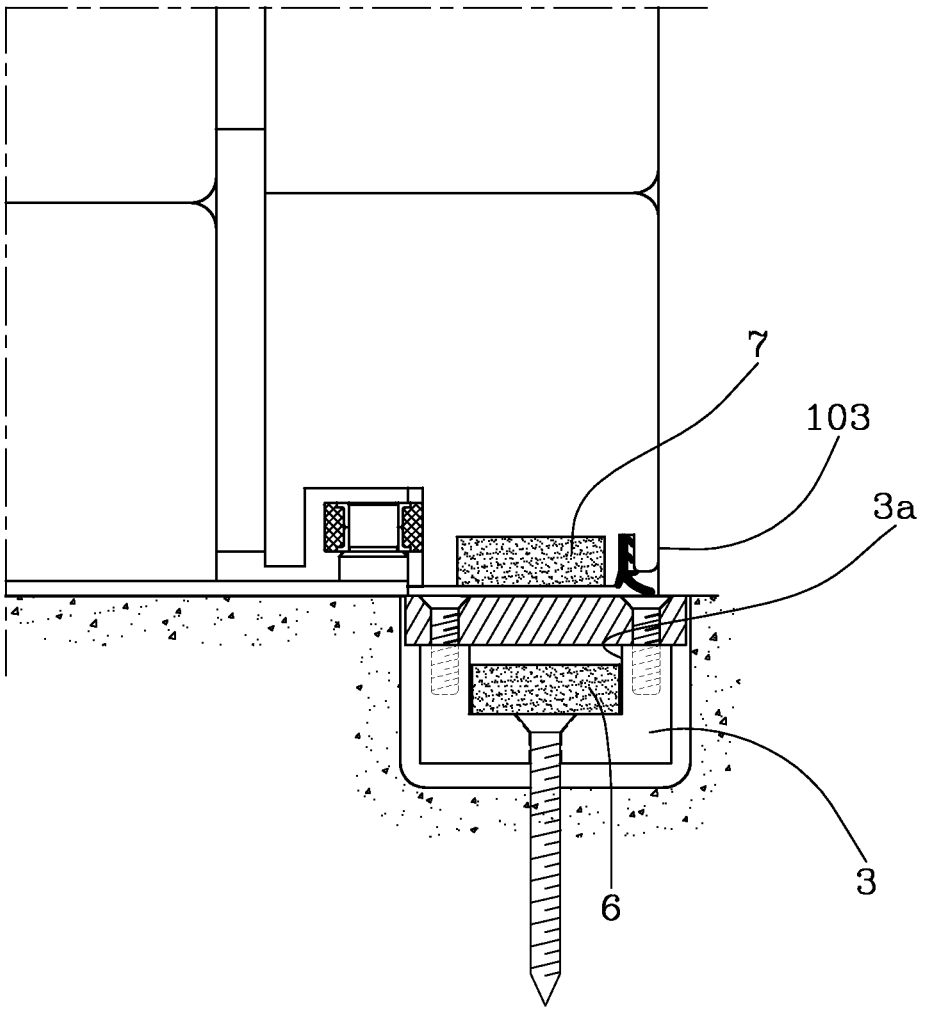
FIG. 2 is a sectional side view of a detail of the guide system in FIG. 1.

With reference to the accompanying figures, the number "1" indicates a guide system for sliding doors according to the present invention. Although it can be associated with a door 101, this guide system 1 does not comprise this door.

In detail, the guide system 1 comprises a pair of guides 3, 4 that are opposite each other.

These guides 3, 4 are configured so as to receive the respective opposite edges 103, 104 of the door 101. In further detail, as shown particularly in FIG. 1, the guide 3 is a lower guide, that is to say, located at a lower height with respect to the door 101. Likewise, the guide 4 is an upper guide, that is to say, located at a higher height with respect to the door 101. However, reference will be made below to the lower guide 3 and to the upper guide 4, without loss of generality.

In further detail, each guide 3, 4 has a respective seat 3*a*, 4*a* in which a respective edge 103, 104 of the door 101 can be inserted. In particular, the lower edge 103 of the door 101 is inserted in the seat 3*a* of the lower guide 3. The upper edge 104 of the door 101 is inserted in the seat 4*a* of the upper guide 4.

Note that when the door 101 is installed inside the guides 3, 4, the door 101 is switchable from a resting position in which it is locked within the guides 3, 4, particularly within the seats 3*a*, 4*b*, to a sliding position in which it is slidable along the guides 3, 4, particularly within the seats 3*a*, 4*a*. In other words, in the resting position, the door 101 is in contact with the guide 3.

The guide system 1 further comprises lifting means or lifting device 5 configured so as to switch the door 101 between the resting position and the sliding position. In particular, the lifting means 5 is configured so as to produce a magnetic field inside at least one of the guides 3, 4. Advantageously, in this manner it is possible to oppose the force of gravity without resorting to the muscular strength of the user.

More specifically, the magnetic field produced may be of an attractive or repulsive type, according to the embodiments of the guide system 1. The term "attractive" refers to a magnetic field suitable for producing a force that tends to draw the edge 103, 104 of the door 101 to the respective guide 3, 4. On the contrary, the term "repulsive" refers to a magnetic field suitable for producing a force that tends to repel the edge 103, 104 of the door 101 from the respective guide 3, 4.

In detail, according to a preferred embodiment of the invention (shown in FIGS. 2 and 4-8 according to several variations in construction), the magnetic field is of a repulsive type and it is localized at the lower guide 3.

Figure 9:
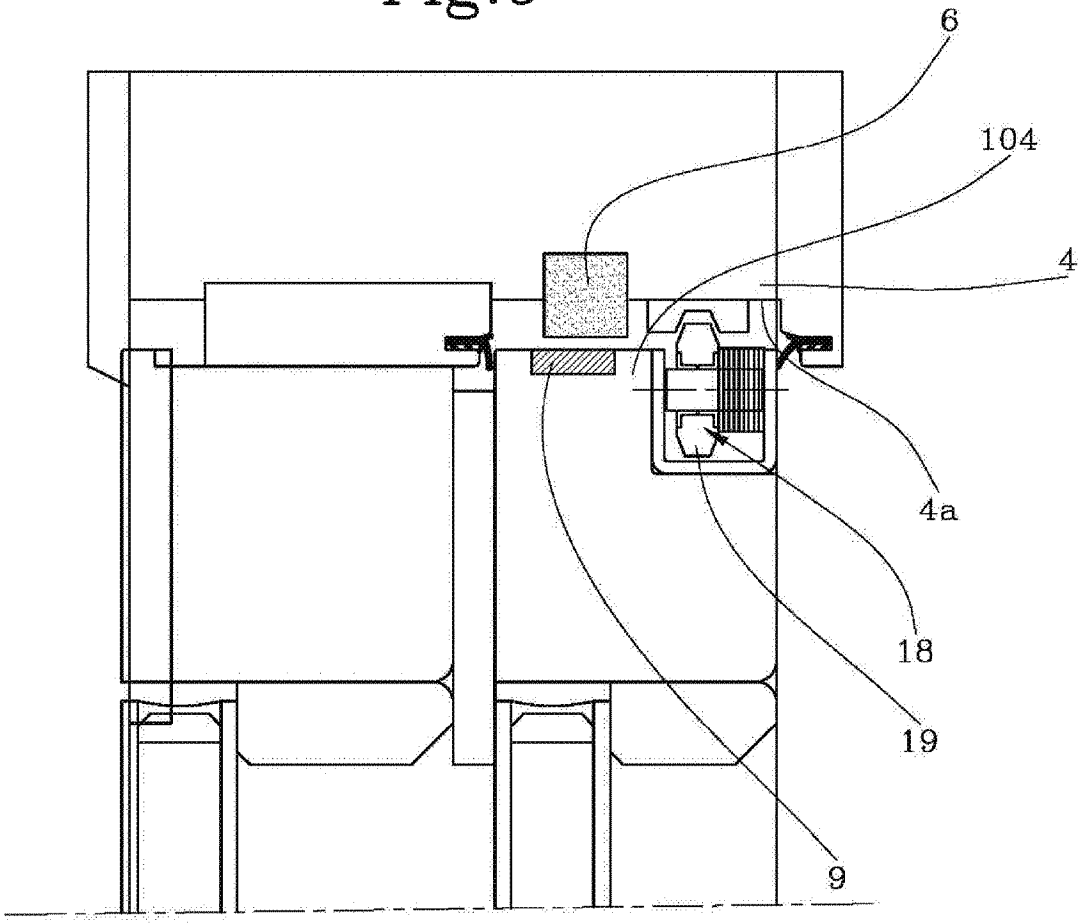
FIG. 9 is sectional side view of a further detail of the guide system in FIG. 1, according to a different embodiment.

In a second embodiment of the invention, shown in FIG. 9, the magnetic field is of an attractive type and it is localized at the upper guide 4.

Figure 3:
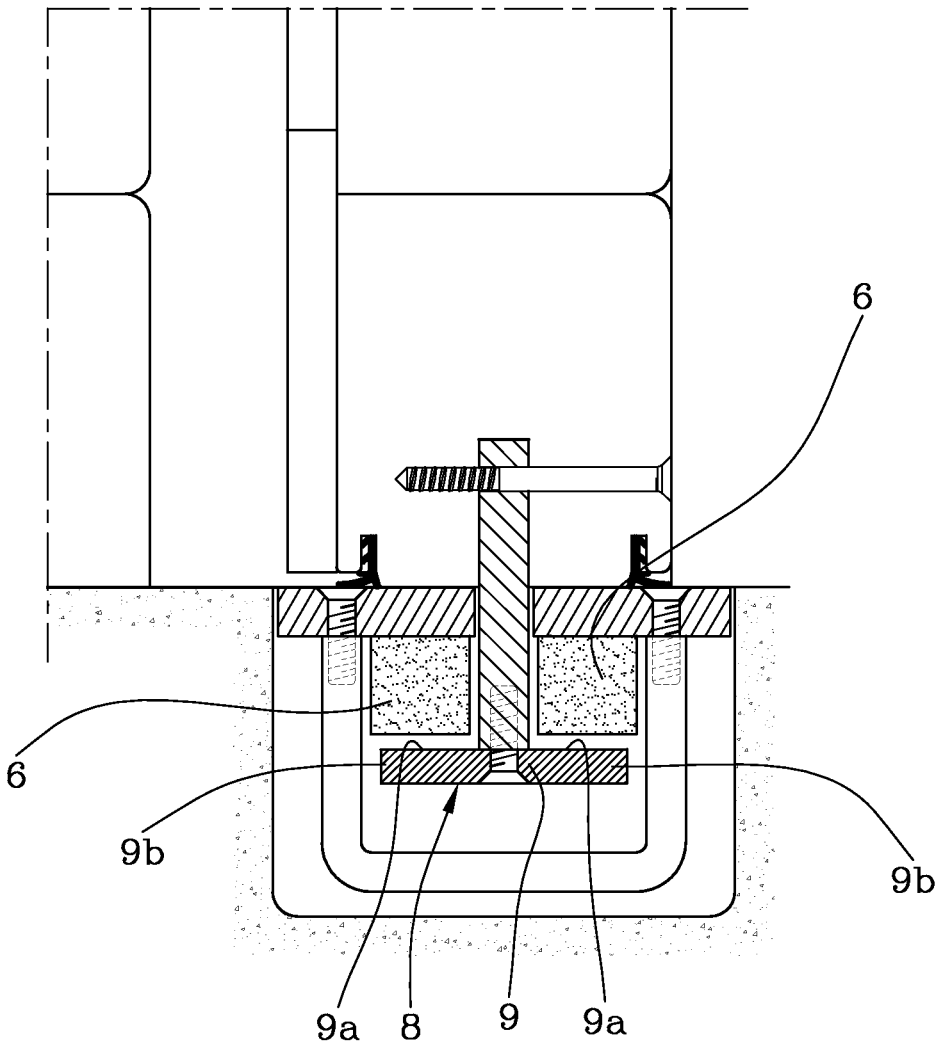
FIGS. 3-8 are sectional side views of the detail in FIG. 2 according to respective alternative embodiments.

In a third embodiment of the invention, shown in FIG. 3, the magnetic field is of the attractive type and it is localized at the lower guide 3.

These embodiments and other additional variants shall be further specified below in this description.

Note that the lifting means 5 comprises at least one magnet 6. This magnet 6 is fixed to one of the guides 3, 4 and preferably located inside the respective seat 3*a*, 4*a*. In particular, in the embodiments shown in FIGS. 2-8, the magnet 6 is fixed to the lower guide 3. In the embodiment appearing in FIG. 9, the magnet 6 is located at the upper guide 4.

In the context of the present description, a "magnet" is intended as a permanent magnet or an electromagnet. In the case in which the magnet 6 and/or the further magnet 7 are permanent magnets, they are preferably made of neodymium.

In greater detail, the lifting means 5 comprises a plurality of magnets 6 arranged along the entire extension of the respective guide 3, 4 in which they are placed. The dimensions, shape, intensity and distance between one magnet 6 and the other can be calibrated according to the weight and the dimensions of the door 101.

In the preferred embodiment of the present invention, the lifting means 5 comprises a further magnet 7 that can be fixed to the door 101 and made to face the magnet 6. In greater detail, the lifting means 5 may comprise a plurality of further magnets 7 arranged along the longitudinal extension of the door 101.

Note that the magnet 6 and the further magnet 7 are configured so as to interact magnetically with each other and to produce a magnetic force of a repulsive type between the door 101 and the lower guide 3. In other words, the magnets 6 and the additional magnets 7 have magnetic poles of the same polarity (North-North) or (South-South) facing each other.

In further detail, the magnet 6 and the further magnet 7 may be of any shape whatsoever. In the embodiments described and illustrated herein, the magnet 6 and the further magnet 7 are shaped in the form of a parallelepiped. In an unillustrated embodiment, it is possible to employ curved magnets 6, that is to say magnets shaped like a curved roof tile or crescent-shaped. Advantageously, this makes it possible to modulate the magnetic field produced by the magnets 6 in such a manner as to limit transient effects due to activation and/or deactivation of the lifting means 5.

In the embodiments in FIGS. 3 and 9, the lifting means 5 comprises a magnetically sensitive element 8. This magnetically sensitive element can be fixed to the door 101 so as to be able to interact with the magnet 6. In other words, the magnetically sensitive element 8 is an element of a passive type, that is, while it does not spontaneously produce a magnetic field, it is capable of reacting to a magnetic field that is applied by an external source. The magnetically sensitive element 8 is preferably made of a ferromagnetic material.

In detail, the magnetically sensitive element 8 can be made to face the magnet 6 in such a manner as to be capable of being magnetically attracted by the magnet 6. In the embodiment in FIG. 9, the magnetically sensitive element 8 can be fixed to an upper edge 104 of the door 101.

In the alternative embodiment in FIG. 3, the magnetically sensitive element 8 can be fixed to the lower edge 103 of the door 101.

In both embodiments, the magnetically sensitive element 8 has an area of magnetic interaction located in a lower position with respect to the magnet 6. In particular, in the embodiment in FIG. 9, the magnetically sensitive element 8 is a bar 9, preferably of ferromagnetic material. The area of magnetic interaction is an upper surface 9*a* of this bar 9.

In the embodiment in FIG. 3, the bar 9 has an upside-down T-shaped section, that is to say it has a pair of lateral projections 9*b*. In this case, the area of magnetic interaction is the upper surface 9*a* of the lateral projections 9*b*.

In the embodiments in FIGS. 4-8, the guide system 1 comprises a support element 10 for the magnet 6 and associated with one of said guides 3, 4, particularly with the lower guide 3.

In particular, the magnet 6 is fixed to the support element 10. In particular, the support element 10 is switchable between an activation position, wherein the magnet 6 and the further magnet 7 are positioned in such a position as to interact magnetically between each other, and a deactivation position. Although this solution is also applicable in the case in which the magnet 6 is an electromagnet, it proves to be particularly advantageous in the case in which it is a permanent magnet. In fact, it is possible to realize a guide system 1 according to the present invention without requiring an electric power supply, but based solely on activation of a mechanical type.

Figure 4:
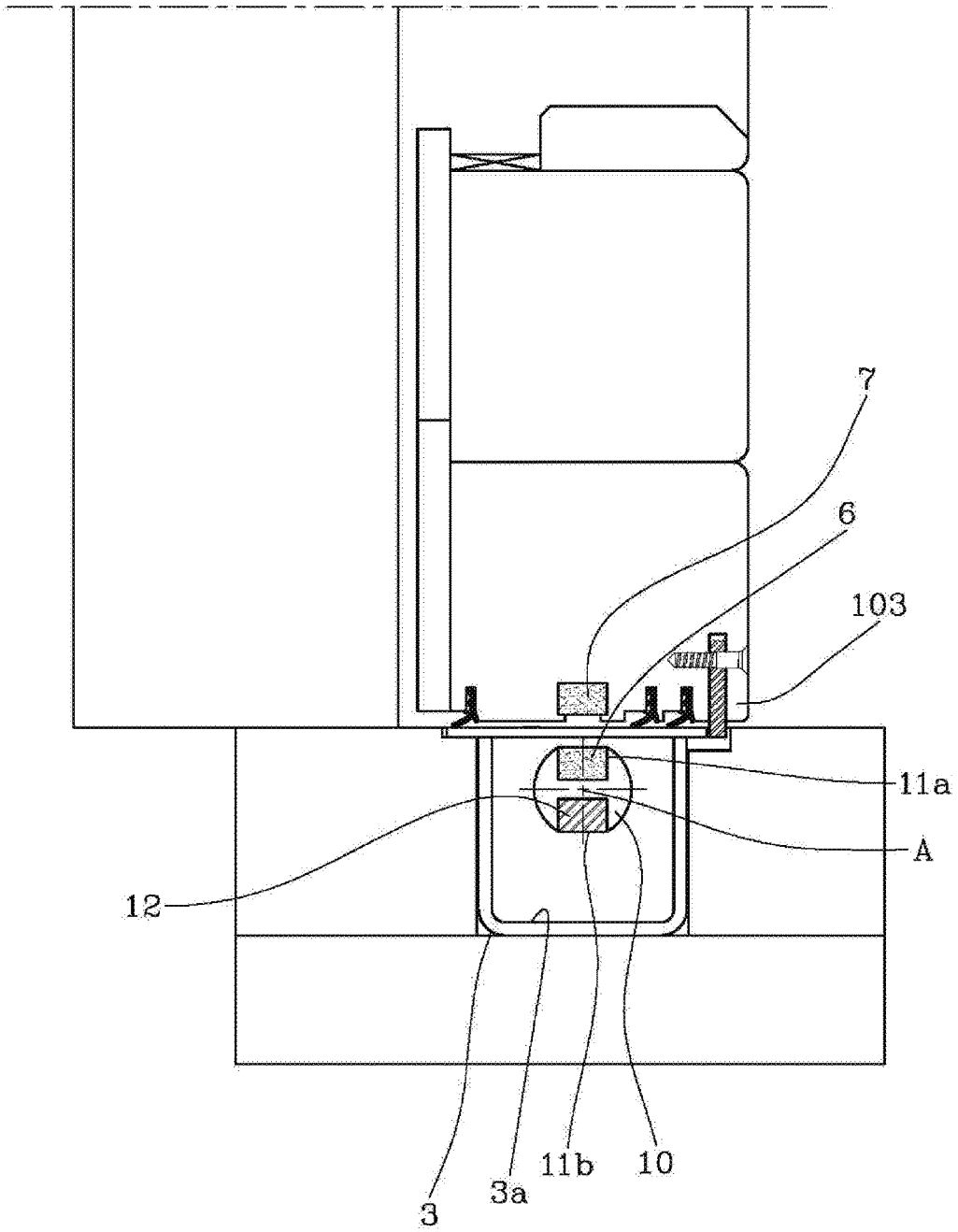

In detail, FIG. 4 shows a first embodiment of the support element 10. In this case, the support element 10 comprises a beam 11 predisposed to rotate about a longitudinal axis "A" thereof. The beam 11 is preferably connected to the lower guide 3 and in particular, it is sustained by a plurality of supports (unillustrated) distributed along the entire length thereof, as needed. Such supports enable the beam 11 to rotate about the longitudinal axis "A" thereof. The beam 11 comprises a first housing 11*a*, wherein the magnet 6 is inserted. The beam 11 rotates preferably by 180°, in such a manner that in the activation position, the first housing 11*a* faces the additional magnet 7, whereas in the deactivation position, it is distanced away from the additional magnet 7.

The beam 11 may also have a second housing 11*b*, diametrically opposite the first housing 11 a, wherein an attenuation element 12 for attenuating the magnetic field can be inserted. Advantageously, this attenuation element 12 is capable of reducing any residual magnetic interactions that may be present between the magnet 6 and the further magnet 7 even when the magnet 6 is in the deactivation position. By way of example, the attenuation element 12 may be made of Mu-metal, that is, a type of nickel-iron alloy having high magnetic permeability. A further variant (unillustrated) of the embodiment shown in FIG. 4 comprises arranging two magnets 7 solidly constrained to the door 101. These two magnets 7 solidly constrained to the door 101 are abreast of each other and arranged in a position that is substantially symmetrical to the underlying magnet 6 associated with the lower guide 3. The use of two magnets 7 solidly constrained to the door 101 makes it possible to increase the overall stability of the guide, in that they substantially produce a self-centring effect that keeps the door 101 in a centred, stable position with respect to the lower guide 3.

Figure 5:
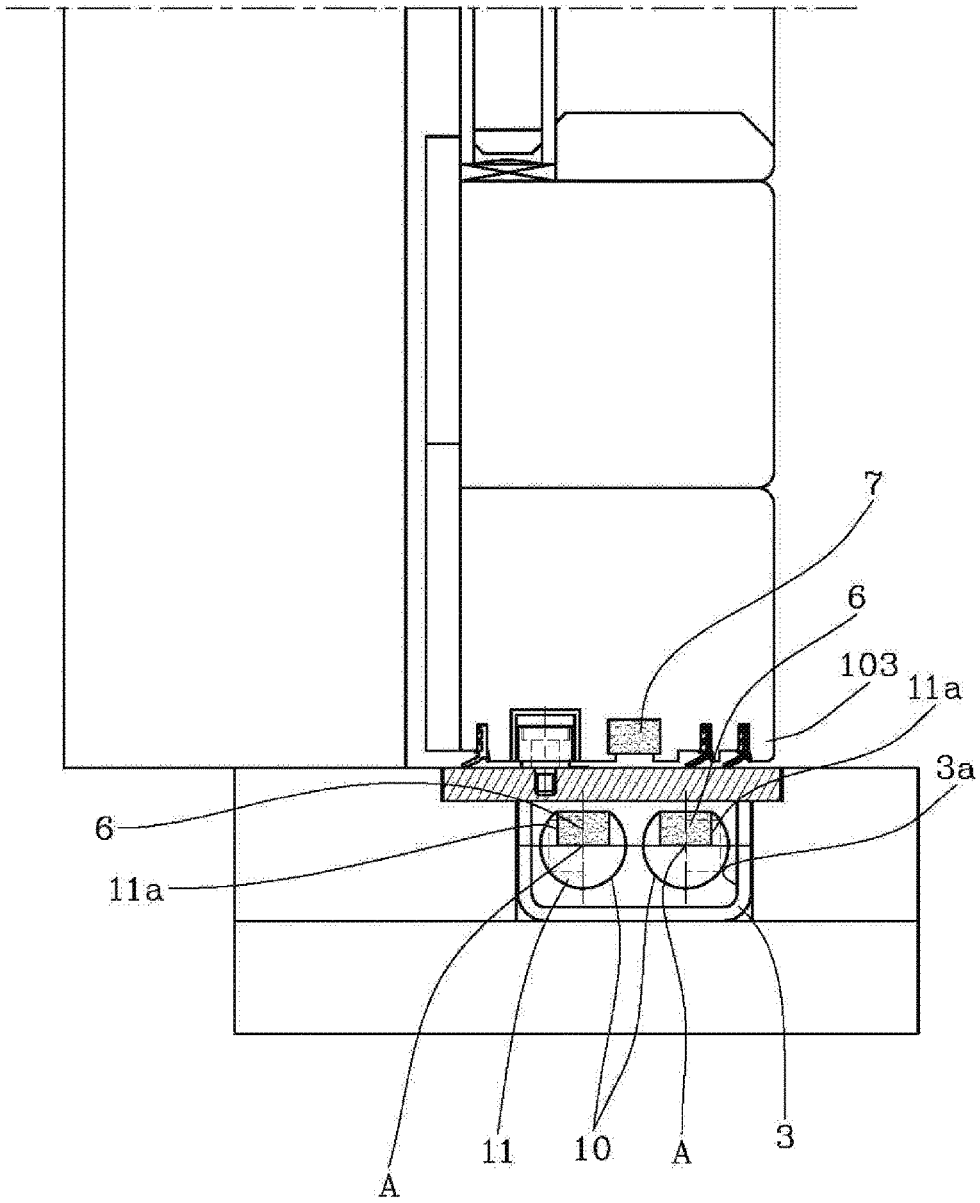

The embodiment shown in FIG. 5 differs from the embodiment appearing in FIG. 4 in that it comprises a pair of support elements 10, each of which is defined by a respective beam 11. Each beam 11 is coupled with a respective magnet 6. The beams 11 can rotate preferably by 90° towards the exterior of the lower guide 3. Advantageously, in this manner, the magnetic field developed by the magnets 6 always remains symmetrical with respect to the lower guide 3 while the support elements 10 switch between the deactivation configuration and the activation configuration, and vice versa.

In an unillustrated variant of this embodiment, there is a single support element 10, whereupon a magnet 6 is installed. A pair of additional magnets 7 are arranged parallel to each other and in particular, parallel to the lower guide 3. Advantageously, this makes it possible to achieve greater stability of the door 101 and at the same time, considerable simplification in terms of construction.

The embodiments shown in FIGS. 6-9 have the magnet 6 fixed to the upper surface 10*a* of the support element 10. The support element 10 translates away from and towards the door 101, that is, between a distal position and a proximal position, with respect to the door 101. In particular, the distal position corresponds to the deactivation configuration, whereas the proximal position corresponds to the activation configuration. In particular, these embodiments comprise driving means 13 associated with the support element 10 and capable of raising/lowering it.

Figure 6:
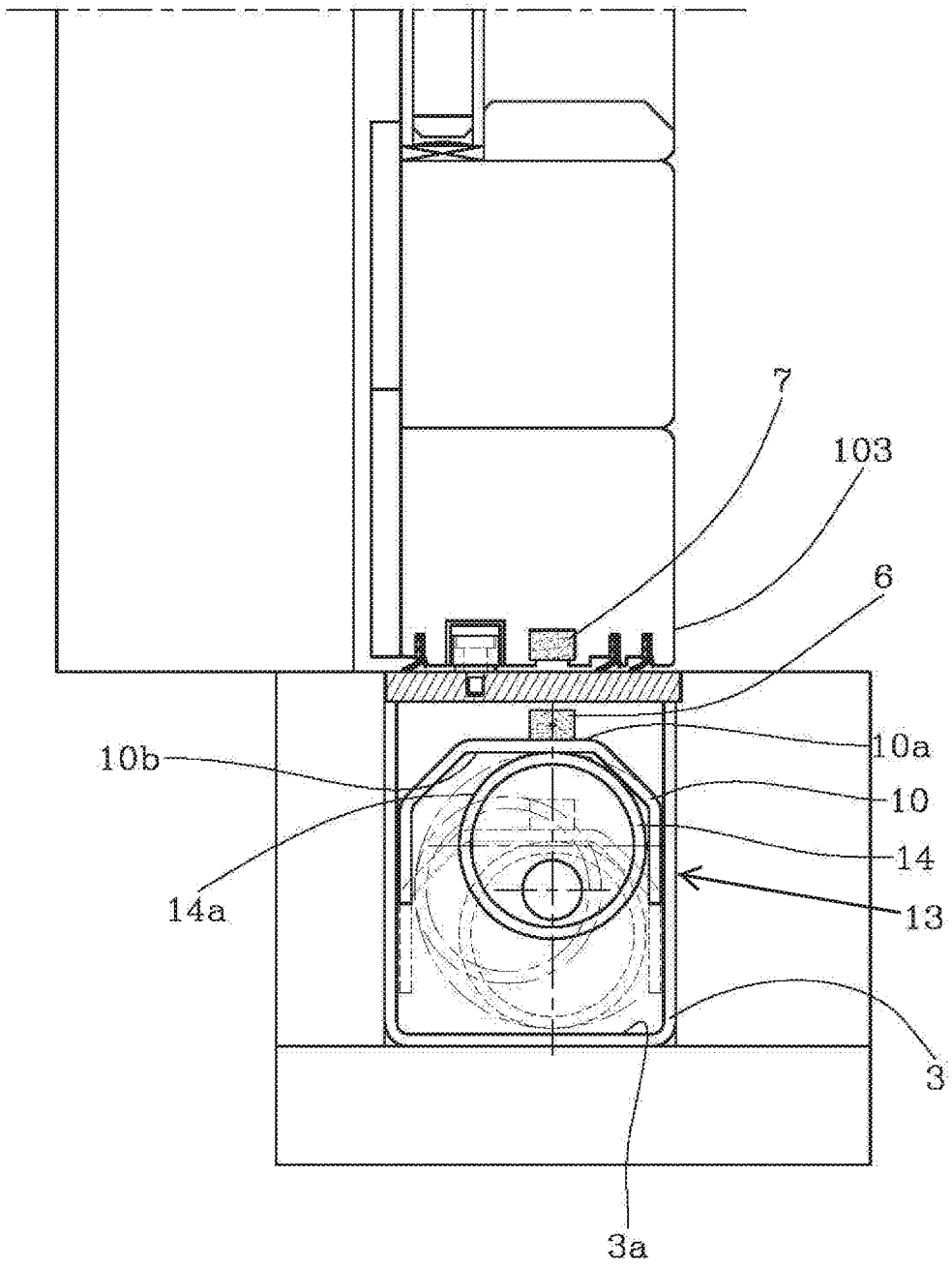

In the embodiment in FIG. 6, the driving means 13 comprises an eccentric element 14 located in a lower position with respect to the support element 10. This eccentric element 14 has a circular perimeter 14*a*, which is in contact with a lower surface 10*b* of the support element 10. By rotating, the eccentric element 14 makes the support element 10 slide along the circular perimeter 14*a* thereof, varying the point of contact instant by instant. As a result, given that the points on the circular perimeter 14*a* are at different distances from the centre of rotation, there is a distancing/nearing of the support element therefrom, and a resulting lifting/lowering of the magnet 6.

Figure 7:
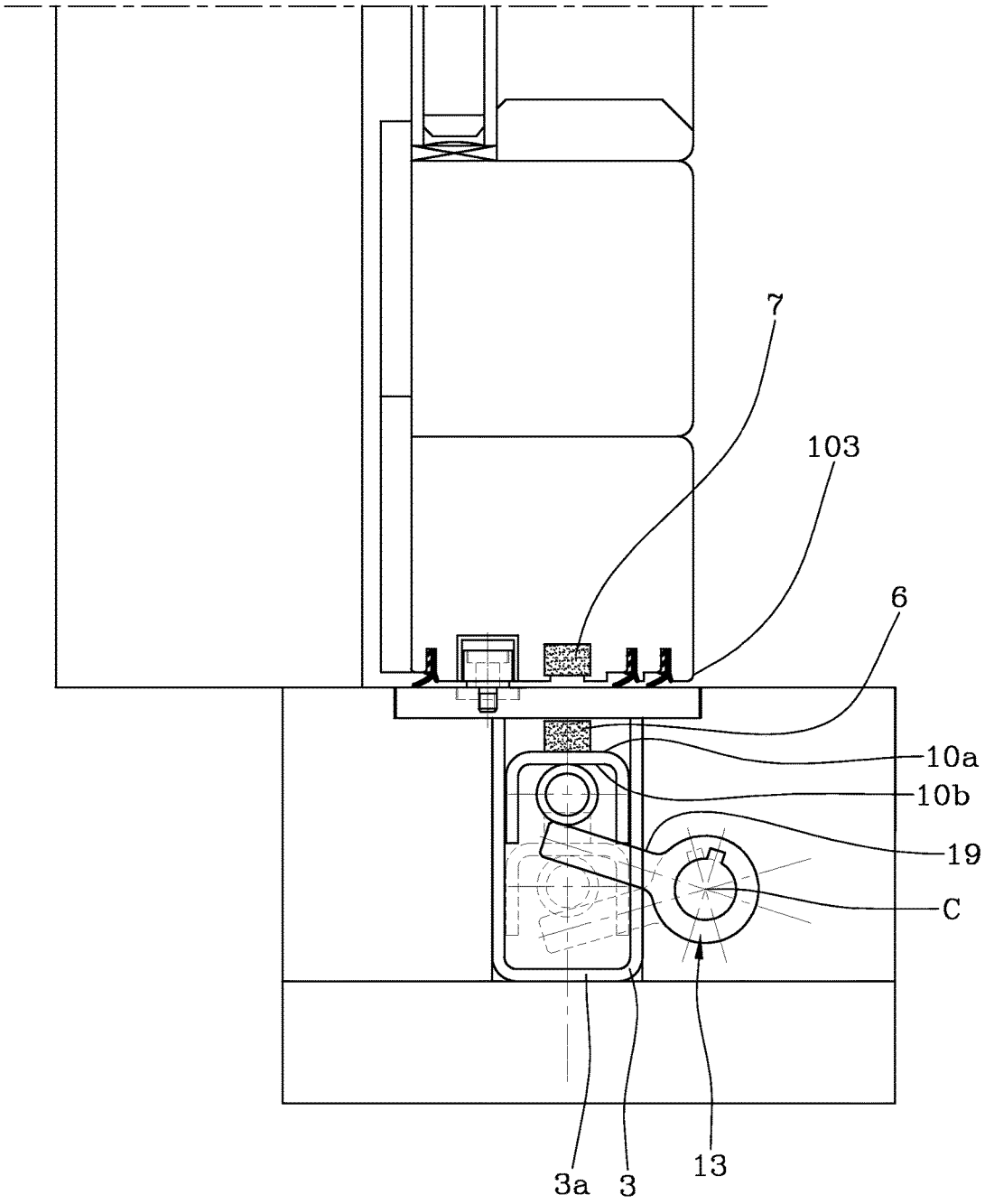

In the embodiment in FIG. 7, the driving means 13 comprises a lever 15 located externally and transversely with respect to the support element 10.

This lever is capable of rotating with respect to a centre of rotation "C" thereof, preferably located at one end. As a result, the lever 15 can raise and/or lower the support element 10.

Figure 8A:
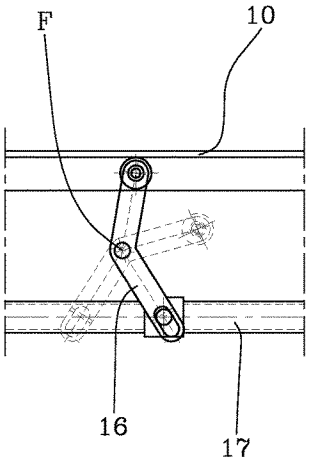
FIG. 8*a* is a side view of the detail in FIG. 8.
Figure 8:
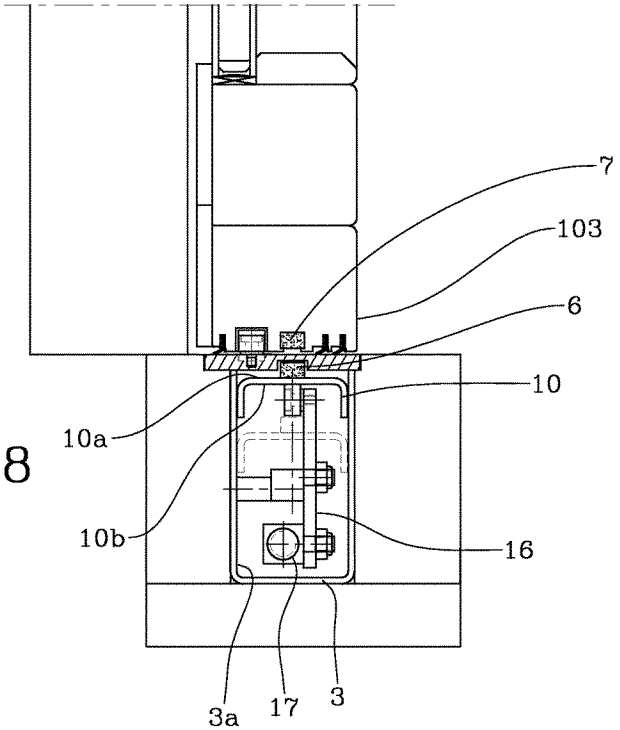

In the embodiment shown in FIGS. 8 and 8*a*, the driving means 13 comprises an arm 16 connected to the support element 10. An actuating element 17 is located under the support element 10, and in particular, parallel thereto. The actuating element 17 can slide inside the lower guide 3, in such a manner as to set the arm 16 in rotation about a fulcrum "F" preferably located in a central zone of the arm 16. The arm 16 thus acts upon the support element 10 in such a manner as to raise/lower it.

Note that in all the embodiments shown in FIGS. 4-9, the driving means 13 may comprise electric movement means (for example a motor) or, more advantageously, mechanical movement means that can be activated directly by the user.

Advantageously, the guide system 1 comprises sliding means 18, preferably rollers 19, which can be associated with the upper edge 104 of the door 101. These rollers 19 are configured so as to slide inside the seat 4*a* of the guide 4, and they allow the door 101 to move even when it is pushed against the upper guide 4 by the magnet 6.

The invention claimed is:

1. A guide system (1) for a sliding door (101), comprising a pair of guides (3, 4) comprising a lower guide (3) and an upper guide (4) opposite each other and configured so as to guide respective opposite edges (103, 104) of the door (101); lifting device (5) configured so as to switch said door (101) from a resting position, to a sliding position, wherein the door (101) is slidable along said guides (3, 4); a support element (10) within one of said pair of guides (3, 4); characterised in that said lifting device (5) is configured so as to produce a magnetic field inside at least one of said guides (3, 4) in such a manner as to bring said door (101) from the resting position to the sliding position;

wherein said lifting device (5) comprises a first magnet (6) within the lower guide (3);

wherein said lifting device (5) comprises a second magnet (7) fixed to said door (101) and facing said first magnet (6);

wherein said first magnet (6) is fixed to said support element (10), said support element (10) being moveable between an activation position, wherein said first magnet (6) and said second magnet (7) are positioned sufficiently close to each other so that said first magnet (6) and said second magnet (7) interact magnetically to produce a magnetic force that effectively repulses said door (101) from the lower guide (3) and brings the door (101) from the resting position to the sliding position, and a deactivation position, wherein said first magnet (6) and said second magnet (7) are positioned further from each other compared to the activation position, so that said first magnet (6) and said second magnet (7) are less magnetically interactive than when in said activation position; and wherein said first magnet (6) and said second magnet (7) are permanent magnets.

2. The guide system (1) according to claim 1, comprising a sliding device (18) associated with an upper edge (104) of said door (101).

3. The guide system according to claim 2, wherein said sliding device (18) comprises rollers (19).

4. A kit comprising the sliding door (101) and the guide system (1) according to claim 1.

5. The guide system according to claim 1, wherein said first magnet (6) and said second magnet (7) are neodymium magnets.

6. The guide system according to claim 1, wherein said support element (10) is rotatable between said activation position and said deactivation position.

7. The guide system according to claim 1, wherein the support element (10) comprises a beam (11) having a longitudinal axis (A), the first magnet (6) being attached with the beam (11), the beam (11) being rotatable about the longitudinal axis (A) between the activation position and the deactivation position.

8. The guide system according to claim 1, wherein the first magnet (6) is fixed to an upper surface (10*a*) of the support element (10), the support element (10) being translatable between the activation position and the deactivation position.

9. The guide system according to claim 8, wherein the support element (10) is translatable towards the door (101) to achieve the activation position and is translatable away from the door (101) to achieve the deactivation position.

10. The guide system according to claim 9, wherein the support element (10) is associated with an eccentric element (14) which, when rotated, causes the first magnet (6) to translate towards or away from the door (101).

11. The guide system according to claim 9, wherein the support element (10) is associated with a lever (15) which, when moved, causes the first magnet (6) to translate towards or away from the door (101).

* * * * *